US008760356B2

(12) United States Patent
Bu et al.

(10) Patent No.: US 8,760,356 B2
(45) Date of Patent: Jun. 24, 2014

(54) BI-POLARIZED BROADBAND RADIATION UNIT OF ANNULAR TYPE AND LINEAR ARRAY ANTENNA

(75) Inventors: Binlong Bu, Guangzhou (CN); Peitao Liu, Guangzhou (CN); Shanqiu Sun, Guangzhou (CN); Songdong Fan, Guangzhou (CN); Xiaobing Su, Guangzhou (CN)

(73) Assignee: Comba Telecom System (China) Ltd. (TW)

( * ) Notice: Subject to any disclaimer, the term of this patent is extended or adjusted under 35 U.S.C. 154(b) by 668 days.

(21) Appl. No.: 12/740,785

(22) PCT Filed: Aug. 1, 2008

(86) PCT No.: PCT/CN2008/001407

§ 371 (c)(1),
(2), (4) Date: Aug. 17, 2010

(87) PCT Pub. No.: WO2009/056001

PCT Pub. Date: May 7, 2009

(65) Prior Publication Data

US 2010/0309084 A1 Dec. 9, 2010

(30) Foreign Application Priority Data

Oct. 30, 2007 (CN) ..... 2007 1 0031144

(51) Int. Cl.
*H01Q 21/20* (2006.01)

(52) U.S. Cl.
USPC ..... 343/799; 343/820; 343/821; 343/802; 343/807

(58) Field of Classification Search
USPC ..... 343/799, 820, 821, 824, 835, 826, 802, 343/807
See application file for complete search history.

(56) References Cited

U.S. PATENT DOCUMENTS

| | | | | |
|---|---|---|---|---|
| 4,083,051 | A * | 4/1978 | Woodward | 343/797 |
| 4,434,425 | A | 2/1984 | Barbano | |
| 6,034,649 | A * | 3/2000 | Wilson et al. | 343/795 |
| 6,333,720 | B1 | 12/2001 | Gottl et al. | |

(Continued)

FOREIGN PATENT DOCUMENTS

| | | |
|---|---|---|
| CN | 2676432 Y | 2/2005 |
| CN | 1663075 A | 8/2005 |

OTHER PUBLICATIONS

International Search Report for Application No. PCT/CN2008/001407 dated Nov. 20, 2008.

*Primary Examiner* — Jerome Jackson, Jr.
*Assistant Examiner* — Collin Dawkins
(74) *Attorney, Agent, or Firm* — Lerner, David, Littenberg, Krumholz & Mentlik, LLP

(57) ABSTRACT

A broadband radiation unit includes first and second pairs of symmetric dipoles operable to transmit communication signals and to receive communication signals. The first pair of symmetric dipoles has a polarization that is orthogonal to that of the second pair of symmetric dipoles. The first and second pairs of symmetric dipoles together define an annular structure. A plurality of baluns are associated with the first and second pairs of symmetric dipoles such that a given one of the baluns is associated with a respective symmetric dipole of the pairs of symmetric dipoles. Each one of the baluns feeds a balanced current to its associated symmetric dipole. Each symmetric dipole of the first and second pairs of symmetric dipoles has two unit arms which are disposed on and arranged symmetrically about its associated balun.

5 Claims, 5 Drawing Sheets

(56) References Cited

U.S. PATENT DOCUMENTS 6,545,644 B1 * 4/2003 Sinclair et al. ..... 343/767
7,075,498 B2 * 7/2006 Gottl et al. ..... 343/797
2004/0183739 A1 9/2004 Bisiules et al.
2004/0252071 A1 * 12/2004 Bisiules et al. ..... 343/797
2007/0229385 A1 10/2007 Deng et al.

* cited by examiner

BI-POLARIZED BROADBAND RADIATION UNIT OF ANNULAR TYPE AND LINEAR ARRAY ANTENNA

CROSS-REFERENCE TO RELATED APPLICATIONS

The present application is a national phase entry under 35 U.S.C. §371 of International Application No. PCT/CN2008/001407 filed Aug. 1, 2008, the disclosure of which is incorporated herein by reference, which claims priority from Chinese Application No. 200710031144.3, filed Oct. 30, 2007.

FIELD OF THE INVENTION

The invention relates to antennas used in mobile communications and more particularly, to a bi-polarized broadband radiation unit of annular type with minimized volume and to a linear array antenna incorporating such bi-polarized broadband radiation unit.

BACKGROUND OF THE INVENTION

With advances in telecommunications technology, 2G and 3G networks are expected to co-exist for a long time. To meet the coverage requirement of such different communication networks, more rigorous quality requirements are required for mobile telecommunication systems. In particular, a broadband antenna capable of operating in both the 2G frequency band and the 3G frequency band is strongly desired.

To optimize networks of various communication systems, the antennas used must provide a high precision horizontal beam width. Lobe-shaping should also be taken into account in designing the elevation pattern to suppress the upper side lobe and to realize zero filling of the lower side lobe, thereby attaining more reliable communication quality. Furthermore, polarization diversity technology has been applied to antennas of base stations to eliminate multi-path fading, thus also greatly improving communication quality.

Base station antennas are important outside components of mobile telecommunication systems. Presently, bi-polarization is a major polarization diversity of such base stations. The bi-polarized antennas mainly include those polarized by an angles of ±45°, which mostly include antennas having a horizontal beam width of 65°. The performance of this kind of antenna (with the horizontal beam width of 65°) directly impacts the coverage and polarization diversity gain of the mobile telecommunication systems and therefore impacts working performance of the entire network.

A conventional bi-polarized base station antenna with a polarization angle of ±45° is constructed either of radiation units provided with symmetric dipoles or of microstrip radiation units. The relative operating frequency of this kind of antenna with high cross polarization discrimination is less than 10%, thus influencing the correlation between +45° antenna and −45° antenna and influencing diversity efficiency of the antenna working at a wide frequency range. The value of the cross polarization discrimination also influences the separation between output ports. Further, the gain of the antenna is decreased, the switch time in margin regions is increased, and the communication quality of the network deteriorates due to wide horizontal half power beam width of the symmetric dipole radiation unit. In addition, the working frequency range of a conventional symmetric dipole antenna is only about 13%. Moreover, antennas constructed of microstrip radiation units have an even narrower frequency range of no more than 10%.

A radiation unit is disclosed in U.S. Pat. No. 4,434,425, assigned to GTE Products Corporation and published in 1984, the disclosure of which is incorporated by reference herein. The patent shows a solution to the above issue, in which the high frequency dipole is incorporated into the low frequency dipole, as illustrated in FIG. 1. The combination of the low-frequency antenna radiation unit with the high frequency antenna radiation unit shows a way to realize small-sized, multiple frequency community base station antennas.

A multiple frequency community base station antenna used in mobile communication system is described in U.S. Pat. No. 6,333,720 B1, issued to the German company Kathrein and published in 2001, the disclosure of which is incorporated by reference herein, and is shown in FIG. 2. The apparent interrelationship among the radiation units is the same as that disclosed in U.S. Pat. No. 4,434,425.

However, the radiation units described in both of the above patents suffer from various drawbacks, such as a large frontal projected area and a complicated construction. Additional drawbacks are set forth below.

Firstly, high frequency radiation performance deteriorates due to the coupling effect of the two low frequency dipoles on the high frequency dipole when located between the two low frequency dipoles.

Secondly, if restricted control of the vertical grating lobe of a multiple frequency electronically adjustable base station antenna is required for the communication system, then the pitch between the radiation units is reduced, thus causing more significant coupling between the two low frequency dipoles as well as between the low and high frequency dipoles. In some cases, this coupling is unacceptable and causes great damage to the circuitry and radiation characteristics of the antenna.

Multiple frequency community base station antennas commonly have no high frequency dipole incorporated into the low frequency dipole. By contrast, a low frequency dipole having high frequency dipole included therein has a significantly different impedance performance than a low frequency dipole that does not have such a high frequency dipole contained therein.

Accordingly, the technical evolution of the radiation unit is very complicated, though its design seems simple physically. It is therefore desired to balance the relationship between size and electrical performance, i.e., the technical parameters, of the radiation unit.

It is thus desirable to overcome drawbacks described above and provide a bi-polarized broadband radiation unit of annular type with not only improved performance of various parameters of the radiation unit but also with reduced size thereof.

It is further desirable to provide a linear array antenna with such radiation unit incorporated therein.

BRIEF SUMMARY OF THE INVENTION

The bi-polarized broadband radiation unit of annular type provided by the invention may be mounted onto a metal reflection plate to constitute a communication antenna. The bi-polarized broadband radiation unit of annular type includes two pairs of symmetric dipoles used for transmitting or receiving communication signals, a respective balun corresponding to each symmetric dipole to feed current to the symmetric dipoles in a balanced manner. Each symmetric dipole has two unit arms both of which are fixed symmetrically onto and about the balun.

According to an embodiment of the invention, each unit arm of the symmetric dipole is arc-shaped. The symmetric dipoles together may define an annular construction.

According to another embodiment of the invention, each unit arm of each symmetric dipole is configured as a straight line. The symmetric dipoles may cooperatively define an octagon.

According to yet another embodiment of the invention, each unit arm of each symmetric dipole is constructed by connecting multiple linear segments together. Thus, the symmetric dipoles may together define a construction that has at least sixteen sides which are connected to one another.

According to still another embodiment of the invention, one end of each unit arm may be coupled to a respective balun, and the other end of the unit arm may have a downwardly extended loading post formed thereon. The loading post may be a curved portion of the unit arm.

Each unit arm may have a plurality of tuning bars. The cross-sectional area of each tuning bar may be greater than the cross-sectional area of the unit arm.

A pair of symmetric dipoles of the same polarity have a pitch of between 0.4-0.6 wavelengths. The symmetric dipoles may also have a common length of 0.4-0.6 wavelengths. The polarization directions of two pairs of the symmetric dipoles may be orthogonal to each other. The baluns may each be disposed on an annular base.

Another aspect of the present invention provides a linear array antenna which includes a metal reflection plate that serves as a reflector. At least two radiation units, as described above, are positioned on the metal reflection plate for transmitting and receiving signals on a first frequency band. In addition, at least another radiation unit is positioned on the metal reflection plate and transmits and receives signals on a second frequency band. At least one of the radiation units that transmit signals on the second frequency band is installed into a space defined by the two pairs of symmetric dipoles of the radiation unit that transmits signals on the first frequency band. The radiation units of the same frequency band constitute a respective linear array antenna.

The bi-polarized broadband radiation unit of annular type provided by the invention provides a wide bandwidth, high efficiency, high isolation, high cross polarization discrimination, and low discreteness of beamwidth over changes of the frequency. Therefore, the unit can be used independently as a single antenna and, more often, as a base unit that forms an array antenna, especially a multiple community base station antenna array into which a dipole operating at a high frequency can be incorporated. Radiation performance parameters may be determined by unit performance, with the number of the units of the antenna array depending on critical condition of the antenna. Good electrical and radiation performance can be attained by suitably combining the above together.

DETAILED DESCRIPTION

The invention is described below in more detail with reference to the drawings and embodiments thereof.

Figure 3:
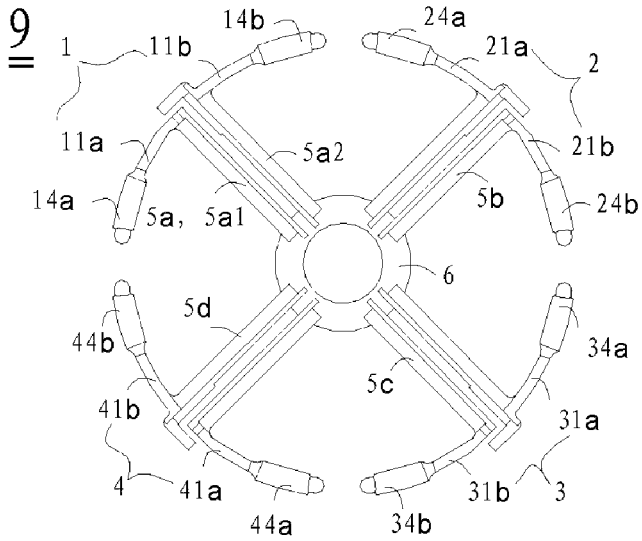
FIG. 3 shows a top plan view of a radiation unit according to a first embodiment of the invention.
Figure 4:
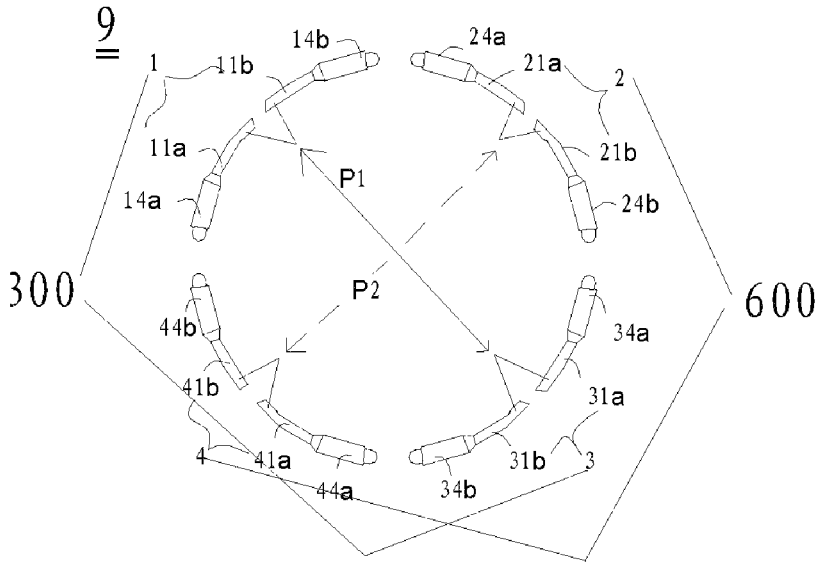
FIG. 4 shows a schematic view of two pairs of symmetric dipoles which cooperatively generate bi-polarized radiation according to the first embodiment of the invention.

FIGS. 3 and 4 depict a first embodiment of the invention. A bi-polarized broadband radiation unit of annular type 9 includes two pairs of symmetric dipoles formed of symmetric dipoles 1, 2, 3 and 4 (four dipoles in total). That is, a first pair of symmetric dipoles 300 is constructed of dipoles 1 and 3, whereas a second pair of symmetric dipoles 600 is constructed of dipoles 2 and 4. The radiation unit 9 also includes four baluns 5*a*, 5*b*, 5*c* and 5*d* which are provided in correspondence with the number of symmetric dipoles. Each of the baluns 5*a*, 5*b*, 5*c* and 5*d* is fixedly placed on an annular base 6.

The symmetric dipoles 1, 2, 3, 4 are disposed on the baluns 5*a*, 5*b*, 5*c* and 5*d*, respectively. Each of the baluns 5*a*, 5*b*, 5*c* and 5*d* is supported by the annular base 6. The balun 5*a*, as an example, is formed of two parallel connection members 5*a*1 and 5*a*2. A line slot is defined in one of the connection members 5*a*1 and 5*a*2 for receiving electrical lines therein. The electrical lines may be used to electrically connect the balun to its corresponding symmetric dipole 1, 2, 3 and 4, thereby enabling feeding in a balanced manner. Each one of the baluns 5*a*-5*d* is connected through its two parallel connection members (for example, the connection members 5*a*1 and 5*a*2) to two unit arms of the corresponding dipole. The connection enables the dipoles 1, 2, 3, 4 to be supported in balance.

Figure 7:
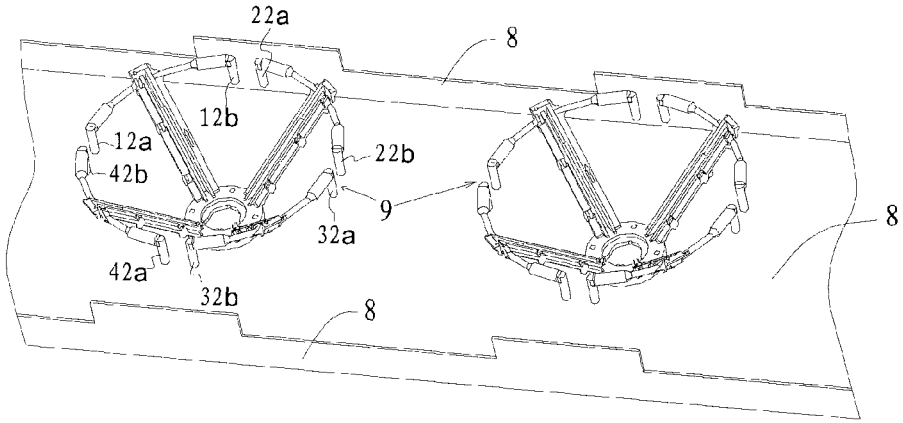
FIG. 7 shows a perspective view of a broadband linear array type of antenna constructed by a plurality of the radiation units of the invention.

Each of symmetric dipoles 1, 2, 3, 4 has an identical construction. The symmetric dipole 1, as an example, contains two arm units 11*a* and 11*b* which are symmetric about the balun 5*a*. One end of each unit arm is secured to the top end of its parallel connection member, whereas the other end is bent to define a loading post 12*a* or 12*b*. A detailed structure of the loading posts is shown in FIG. 7. The loading posts may be formed as separate components and then welded onto a respective unit arm 11*a* or 11*b*. The loading posts allow for an increased a electrical length of the radiation current and a reduced orthographic projection area of the radiation unit 9 in its axial direction, thus reducing the size of the radiation unit 9, decreasing inter-coupling amongst the units, and improving radiation and electrical performance of the array antenna.

Similarly, the two unit arms 21*a* and 21*b* of the symmetric dipole 2 are connected to the balun 5*b*. Corresponding loading posts 22*a* and 22*b* are also provided, as shown in FIG. 7. The two unit arms 31*a* and 31*b* of the symmetric dipole 3 are connected to the balun 5*c*, and corresponding loading posts 32*a* and 32*b* are also provided. The two unit arms 41*a* and 41*b* of the symmetric dipole 4 are connected to the balun 5*d* with corresponding loading posts 42*a* and 42*b* being provided.

A distal end of each unit arm 11*a* (or 11*b*) of the symmetric dipole 1 is configured to have a tuning bar 14*a* (or 14*b*) of which the cross-sectional area is larger than that of the unit arm 11*a* (or 11*b*). The locations of the tuning bars 14*a* and 14*b* on the symmetric dipole 1, together with the size of the bars, can affect the electrical performance of the dipole 1. However, good in-band matching characteristics can be obtained by optimizing the positions and sizes of the bars 14*a* and 14*b*.

In a similar manner, the two unit arms 21*a* and 21*b* of the symmetric dipole 2 also have tuning bars 24*a* and 24*b* respectively provided thereon, the two unit arms 31*a* and 31*b* of the symmetric dipole 3 have tuning bars 34*a* and 34*b* respectively provided thereon, and the two unit arms 41*a* and 41*b* of the symmetric dipole 4 have tuning bars 44*a* and 44*b* respectively provided thereon.

FIG. 4 shows the symmetric dipoles 1 and 3 positioned opposite to one another with a pitch of about 0.4-0.6 working wavelengths. A dipole unit assembly with a polarization P1 may be defined by feeding the dipoles in parallel. Similarly, the pitch between the dipole 2 and the dipole 4 is also 0.4-0.6 wavelengths. The two dipoles 2, 4 are fed with parallel currents, thus constituting a dipole unit assembly having a polarization P2. The polarization P1 is orthogonal to the polarization P2, thus defining a bi-polarized radiation unit 9. The bi-polarized radiation unit may be formed with a polarization angle of ±45°, 0° or 90° for mobile communications according to real world requirements. A circularly polarized radiation unit may be formed when the polarization P1 has the same amplitude as the polarization P2 but has a 90° phase difference with respect to the polarization P2.

Figure 1:
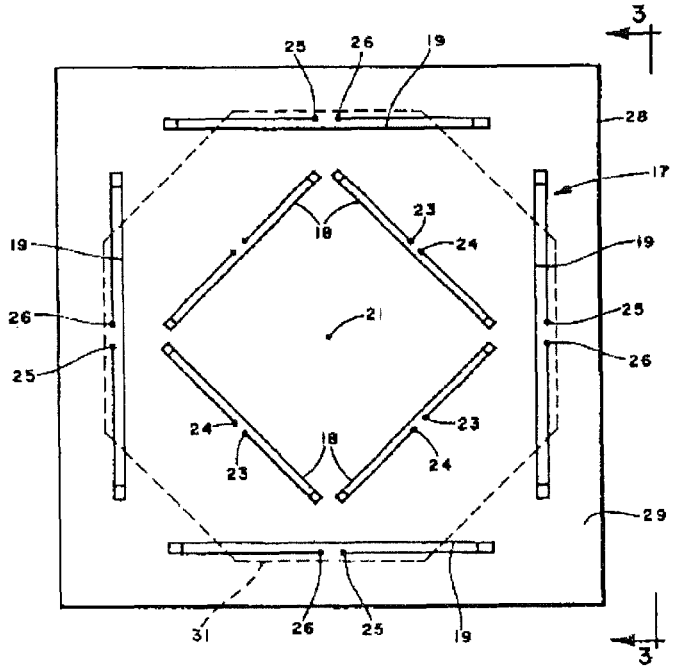
Figure 1 (Prior Art)
FIG. 1 schematically illustrates a construction of a known radiation unit as disclosed in U.S. Pat. No. 4,434,425.
Figure 2:
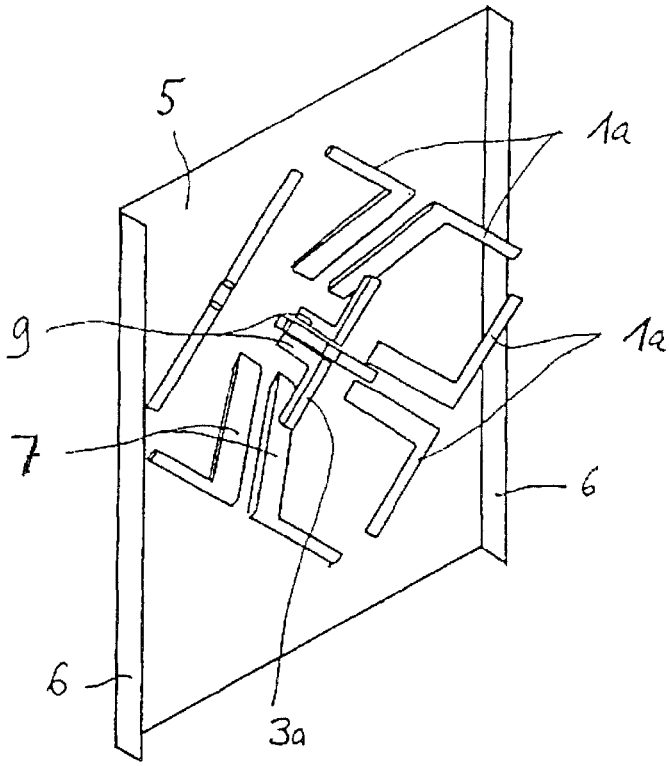
Figure 2 (Prior Art)
FIG. 2 schematically illustrates a construction of another known radiation unit as disclosed in U.S. Pat. No. 6,333,720 B1.

Referring back to FIGS. 3 and 4, the two unit arms 11*a* and 11*b* have a linear shape. To achieve specific advantages of the invention, however, an arc-shape is preferred. The total length of the symmetric dipole 1 is 0.4-0.6 wavelengths. The same applies to the other symmetric dipoles 2, 3, 4. As such, as shown in FIG. 2, the four symmetric dipoles of the radiation unit 9 together define a discontinuous circular arrangement having a broadband bi-polarized function.

Figure 5:
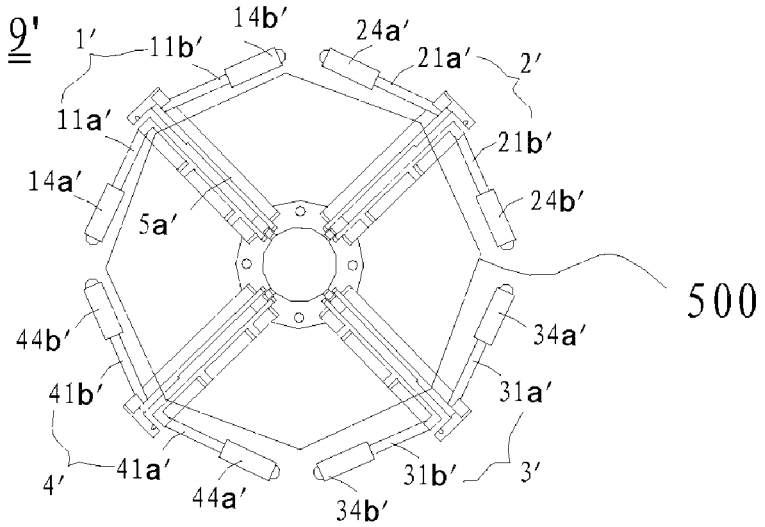
FIG. 5 shows a top plan view of a radiation unit according to a second embodiment of the invention.
Figure 6:
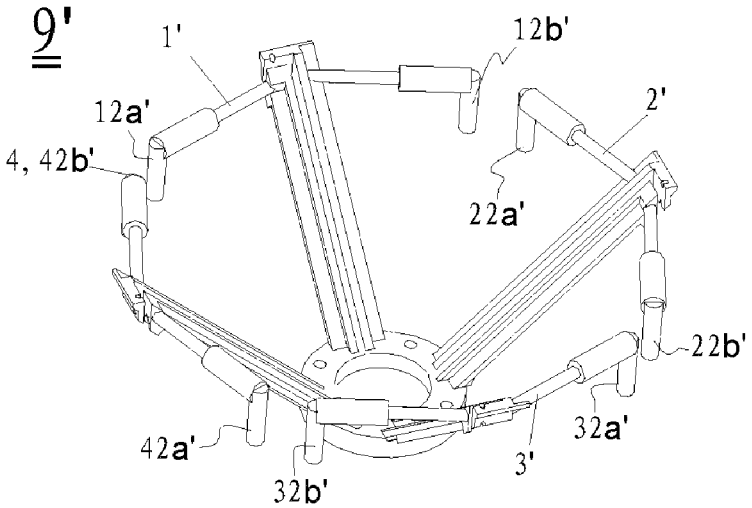
FIG. 6 shows a side view of the radiation unit according to the second embodiment of the invention.

FIGS. 5 and 6 illustrate another embodiment of the invention. This embodiment has the same physical construction as the first embodiment except for the differences described herein.

The unit arms 11*a*' and 11*b*' of the symmetric dipole 1' are of a linear shape. The unit arms, when installed to a balun 5*a*', define an acute angle between the respective unit arm and the balun 5*a*', as shown in FIG. 5. The same relation applies to the unit arms 21*a*', 21*b*', 21*a*', to the unit arms 31*b*', 31*a*', 31*b*', and to the unit arms 41*a*', 41*b*' of the symmetric dipoles 2', 3' and 4', respectively, as shown in a top plan view in FIG. 5. The symmetric dipoles 1' and 3', 2' and 4' of the radiation unit 9' together define a regular octagon 500.

Similar to the first embodiment, the symmetric dipoles 1', 2', 3' and 4' have corresponding tuning bars 14*a*', 14*b*', 24*a*', 24*b*', 34*a*', 34*b*' and 44*a*', 44*b*', respectively, provided thereon as illustrated in FIG. 5. The corresponding loading posts 12*a*', 12*b*', 22*a*', 22*b*', 32*a*', 32*b*' and 42*a*', 42*b*' are also provided.

Figure 5A:
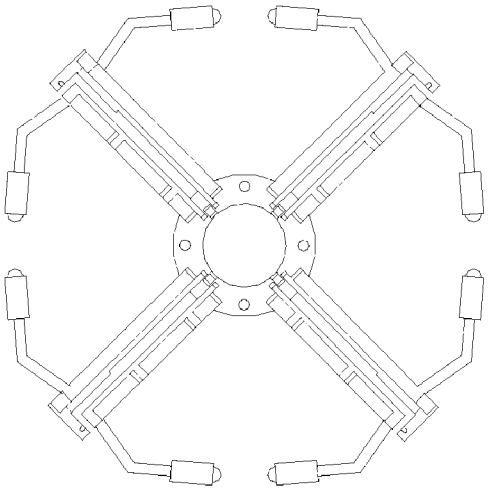
FIG. 5*a* shows a radiation unit configured to be a polygon containing at least sixteen sides.

Based on the design concept of the embodiment, the unit arms 11*a*' and 11*b*' of the symmetric dipole 1' may be have a shape defined by multiple segments which are connected to one another in a predefined order. The same principle applies to the other symmetric dipoles 2', 3' and 4'. As a result, the symmetric dipoles 1', 2', 3' and 4' of the radiation unit 9' together define a polygon having at least sixteen sides such as, for example, the shape shown in FIG. 5*a*.

Figure 8:
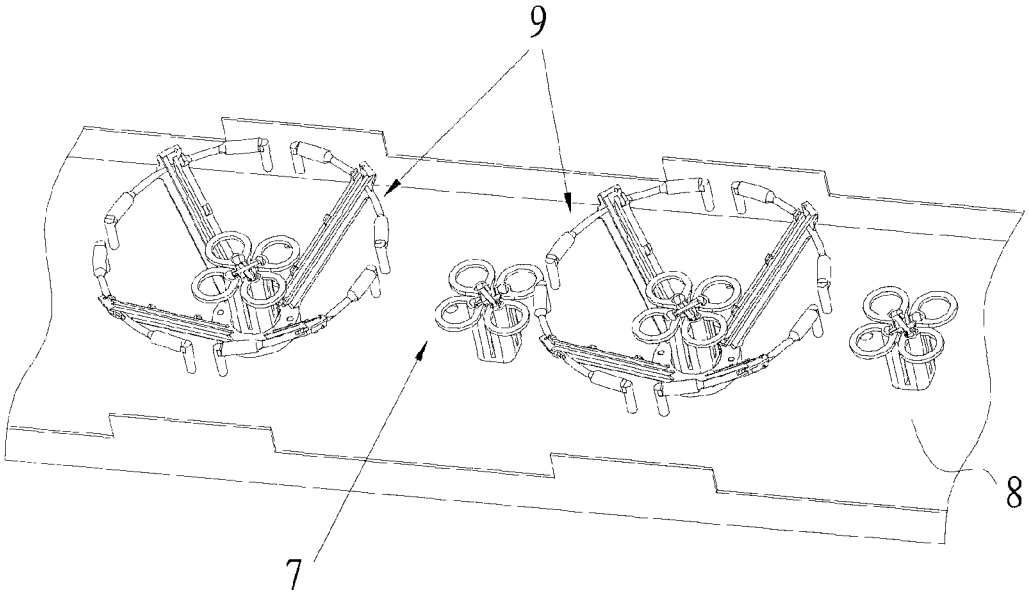
FIG. 8 shows a perspective view of a broadband linear array type of antenna constructed by a plurality of the radiation units of the invention.

The radiation unit 9 shown in FIGS. 3 and 4, or alternatively the radiation unit 9' shown in FIG. 5 or 6, may form a base station antenna of a mobile communications unit such as the linear array antenna shown in FIGS. 7 and 8.

Referring to FIG. 7, the linear array antenna includes a metal reflection plate 8 and plural radiation units 9. The radiation units 9 are seated on the metal reflection plate 8 in a linear arrangement to feed current in parallel. This type of linear array antenna is also referred to as a broadband linear array antenna.

FIG. 8 shows a dual broadband linear array antenna which is somewhat different than that of FIG. 7. This dual broadband linear array antenna is realized by disposing a plurality of high frequency radiation units 7 along the axial direction of the radiation unit 9. The radiation unit 9 (referred to herein as the first radiation unit 9) may transmit and receive signals at a first frequency, whereas the radiation unit 7 (referred to herein as the second radiation unit 7) may transmit and receive signals at a second frequency. At least one radiation unit 7 is incorporated into the radiation unit 9. That is, the unit 7 is located in the space defined by two pairs of symmetric dipoles of the radiation unit. The high frequency radiation unit 7, however, is not limited to the construction as shown in FIG. 8.

The radiation unit 9 of the invention is not limited to a linear array type antenna. Rather, the radiation unit may also be employed in other known antennas which employ bi-polarized radiation units.

Relative to the antenna, the metal reflection plate 8 of the invention is a critical parameter for performance. To achieve specific radiation performance, the structure of the plate should conform to the unit arms of the symmetric dipole of the radiation unit. The structure and size of the plate can be optimized using an antenna simulation.

The antenna produced according to the invention is thus simple in structure and provides good performance. Moreover, the antenna is easy to be produced, is cost-effective and is convenient to assemble.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A broadband radiation unit, comprising:

first and second pairs of symmetric dipoles operable to transmit communication signals and to receive communication signals, the first pair of symmetric dipoles having a polarization that is orthogonal to that of the second pair of symmetric dipoles, the first and second pairs of symmetric dipoles together defining an annular structure; and a plurality of baluns that are associated with the first and second pairs of symmetric dipoles such that a given one of the plurality of baluns is associated with a respective symmetric dipole of the first and second pairs of symmetric dipoles, each one of the plurality of baluns feeding a balanced current to its associated symmetric dipole, wherein each symmetric dipole of the first and second pairs of symmetric dipoles has two circularly cross-sectioned unit arms disposed on and arranged symmetrically with its associated balun, each balun includes two parallel elongated connection members, each elongated connection member is provided with a line slot into which electrical lines are receivable for connecting respective symmetric dipoles, one end of each elongated connection member is disposed on an annular base whereas another end thereof is transversely connected with a respective unit arm, a distal end of each unit arm is provided with a tuning bar, a circularly cross-sectioned loading post is extended downwardly from a distal end of a respective tuning bar, each one of the unit arms includes a plurality of tuning bars, and a cross-sectional area of each tuning bar is greater than a cross-sectional area of the unit arm.

2. The broadband radiation unit according to claim 1, wherein a given pair of symmetric dipoles of the same polarization have a pitch of 0.4-0.6 wavelengths, and the symmetric dipoles of the first and second pairs of symmetric dipoles each have a length of 0.4-0.6 wavelengths.

3. The broadband radiation unit according to claim 2, wherein the direction of polarization of the first pair of symmetric dipoles is orthogonal to the direction of polarization of the second pair of symmetric dipoles.

4. A broadband linear array antenna, comprising:

a metal reflector plate; and at least two radiation units positioned on the metal reflection plate and forming the broadband linear array antenna, each one of the at least two radiation units including:

first and second pairs of symmetric dipoles operable to transmit communication signals and to receive communication signals, the first pair of symmetric dipoles having a polarization that is orthogonal to that of the second pair of symmetric dipoles, the first and second pairs of symmetric dipoles together defining an annular structure, and a plurality of baluns that are associated with the first and second pairs of symmetric dipoles such that a given one of the plurality of baluns is associated with a respective symmetric dipole of the first and second pairs of symmetric dipoles, each one of the plurality of baluns feeding a balanced current to its associated symmetric dipole, wherein each symmetric dipole of the first and second pairs of symmetric dipoles has two unit arms disposed on and arranged symmetrically its associated respective balun, each balun includes two parallel elongated connection members, each elongated connection member is provided with a line slot into which electrical lines are receivable for connecting respective symmetric dipoles, one end of each elongated connection member is disposed on an annular base whereas another end thereof is transversely connected with a respective unit arm, a distal end of each unit arm is provided with a tuning bar, a circularly cross-sectioned loading post is extended downwardly from a distal end of a respective tuning bar, each one of the unit arms includes a plurality of tuning bars, and a cross-sectional area of each tuning bar is greater than a cross-sectional area of the unit arm.

5. A bi-polarized broadband community linear array antenna, comprising:

a metal reflection plate serving as a reflector;

at least two first radiation units each positioned on the metal reflection plate and operable to transmit signals in a first frequency band and to receive signals in the first frequency band, each one of the at least two first radiation units including:

first and second pairs of symmetric dipoles, the first pair of symmetric dipoles having a polarization that is orthogonal to that of the second pair of symmetric dipoles, the first and second pairs of symmetric dipoles together defining an annular structure, and a plurality of baluns that are associated with the first and second pairs of symmetric dipoles such that a given one of the plurality of baluns is associated with a respective symmetric dipole of the first and second pairs of symmetric dipoles, each one of the plurality of baluns feeding a balanced current to its associated symmetric dipole, wherein each symmetric dipole of the first and second pairs of symmetric dipoles has two unit arms disposed on and arranged symmetrically with its associated balun, each balun includes two parallel elongated connection members, each elongated connection member is provided with a line slot into which electrical lines are receivable for connecting respective symmetric dipoles, one end of each elongated connection member is disposed on an annular base whereas another end thereof is transversely connected with a respective unit arm, a distal end of each unit arm is provided with a tuning bar, a circularly cross-sectioned loading post is extended downwardly from a distal end of a respective tuning bar, each one of the unit arms includes a plurality of tuning bars, and a cross-sectional area of each tuning bar is greater than a cross-sectional area of the unit arm; and at least two second radiation units located on the metal reflection plate and operable to transmit signals in a second frequency band and to receive signals in the second frequency band;

wherein a given one of the second radiation units is installed into a space defined by the first and second pairs of symmetric dipoles of a given one of the at least two first radiation units, and the radiation units that transmit signals in a given frequency band define a respective linear array antenna.

* * * * *

UNITED STATES PATENT AND TRADEMARK OFFICE

CERTIFICATE OF CORRECTION

PATENT NO. : 8,760,356 B2
APPLICATION NO. : 12/740785
DATED : June 24, 2014
INVENTOR(S) : Binlong Bu et al.

It is certified that error appears in the above-identified patent and that said Letters Patent is hereby corrected as shown below:

TITLE PAGE, (73), "System (China) Ltd. (TW)" should read -- System (China) Ltd. (CN) --.

Signed and Sealed this
Thirtieth Day of September, 2014

Michelle K. Lee

Michelle K. Lee
*Deputy Director of the United States Patent and Trademark Office*